United States Patent [19]

Yamashita et al.

[11] 4,009,306

[45] Feb. 22, 1977

[54] ENCAPSULATION METHOD

[75] Inventors: Kazuo Yamashita, Kawanishi; Yoshikazu Yokose, Takarazuka; Masatake Akao, Katano; Takashi Shibano, Kawanishi, all of Japan

[73] Assignee: Matsushita Electric Industrial Co., Ltd., Japan

[22] Filed: Sept. 22, 1975

[21] Appl. No.: 615,702

[30] Foreign Application Priority Data

Sept. 26, 1974 Japan ..... 49-111273
Sept. 26, 1974 Japan ..... 49-111274
Sept. 26, 1974 Japan ..... 49-111275

[52] U.S. Cl. ..... 427/374 C; 427/116; 427/375; 427/379; 427/386

[51] Int. Cl.[2] ..... B05D 1/38; B05D 1/18; B05D 5/12; B05D 3/00

[58] Field of Search ..... 427/116, 374, 375, 379, 427/386, 388

[56] References Cited

UNITED STATES PATENTS 3,914,466 10/1975 Ohkuma ..... 427/375 X
3,914,467 10/1975 Akao et al. ..... 427/379 X

*Primary Examiner*—James R. Hoffman
*Attorney, Agent, or Firm*—Wenderoth, Lind & Ponack

[57] ABSTRACT

Encapsulation method not requiring molds and according to which curing of a thermosetting substance which when hardened provides requisite protection to an electrical or other assembly consisting of one or a plurality of elements is effected while the assembly is surrounded by a substance which remains solid and prevents movement of the thermosetting substance out of contact with the assembly during thermoplastic stages of curing thereof, and melts when the thermosetting substance has hardened, whereby the assembly may be moved out of contact therewith.

9 Claims, 9 Drawing Figures

ENCAPSULATION METHOD

The present invention relates to an encapsulation method. More particularly the invention relates to an encapsulation method which is suited for effecting protective encapsulation of electrical parts, and which does not require employment of molds made of metal or similar material and having a fixed shape approximating the shape of an encapsulated article.

It is common practice to provide protection to small articles by embedding the articles in a substance in a liquid state, and subsequently causing hardening of this substance, an article embedded in such hardened substance being said to be an encapsulated article. In the electrical industry in which encapsulation of articles is employed on a large scale, the encapsulating medium generally serves as an insulator as well as protecting an article. The encapsulating substance which is commonly a resin or plastic material, must of course have properties such that an encapsulated article able to function in a required manner, as well as being protected, and for most applications it is also required that encapsulated articles of shape and size to permit interchangeable use thereof, i.e., encapsulated articles are required to be produced to standard dimensions. Such encapsulation utilizes the fact that with increasing temperature, thermosetting resins are initially thermoplastic in character and so may be caused to flow into and around an article to be embedded. At an initial stage, although the resin can be caused to flow under application of external pressure, the resin does not flow naturally, and so retains a shape defining internal and external configurations of the article. However, the resin must be brought to a higher temperature or so-called curing temperature at which the resin undergoes chemical change and sets, and before this temperature is reached the resin, acting like a thermoplastic resin, is liable to flow without application of external pressure. Thus, a problem in encapsulation of articles is to ensure that the resin remains in contact with the article to be encapsulated, i.e. that the article remains embedded in the resin, between the time of initial introduction of the resin into and around the article and the time of complete curing of the resin. In industry the most generally employed method for resolving this problem is to provide molds, generally of metal, which may hold an article to be encapsulated and the encapsulating resin.

For example to effect encapsulation of a transformer by the metal mold method, a bare assembly consisting of coils wound on a bobbin or core and having external connection leads attached thereto is inserted into a metal mold which defines a shape closely approximating the external outline of the bare assembly, and into which resin in a molten state is supplied, for example using transfer-molding techniques, after which the resin is cured, and the encapsulated assembly removed, actual embedding of the assembly and partial curing of the resin usually being effected under vacuum in order to avoid formation of air bubbles or cavities in the encapsulated assembly. The metal mold method is very effective in producing encapsulated assemblies having standard dimensions, but in terms of mass production has definite drawbacks which hitherto have not been solved in a satisfactory manner. A principal disadvantage is the so-called turn-around time of molds, which is the time required to produce one encapuslated assembly and then make the mold ready for encapsulation of the next bare assembly and which obviously influences output rates. Since a mold is occupied at least during the embedding process and the greater part of the curing process, turn-around time is long. Thus, in order to ensure output of encapsulated articles at a suitably high rate it is necessary to make available a great number of molds. This of course represents considerable capital investment, and may be the cause of economic loss if demand for encapsulated articles does not remain at level to justify use of the molds made available, in addition to which, handling and disposition of large numbers of molds presents organizational and maintenance problems. Organization of work procedures is further complicated by the fact that, since each particular mold has a size very close to that of a particular size article, the mold is generally useable for encapsulation of only one type of article. In other words, in production procedures for encapsulation of a variety of articles a variety of molds must be provided and suitably ordered.

It is possible to shorten turn-around time by removing encapsulated articles from molds before hardening of the encapsulating resin is complete, but this procedure requires provision of jiggings or other set-ups for maintaining the required shape of the encapsulated articles.

Work procedures in the metal mold method are further complicated by the fact that it is constantly necessary to apply release agent to all molds in order to ensure efficient release of encapsulated articles therefrom.

It is accordingly a principal object of the invention to provide an improved method for encapsulation of articles on an industrial scale.

It is another object of the invention to provide an encapsulation method not requiring individual molds for articles to be encapsulated.

It is a further object of the invention to provide an article encapsulation method which is economic and involves simple work procedures.

In accomplishing these and other objects there is provided, according to the present invention, an encapsulation method wherein, taking encapsulation of a transformer as an example, a bare assembly which is referred to below simply as 'the article', and which may be constituted by one or more elements is positioned in a container, which is suitably large enough to contain a plurality of articles of varying dimensions, and while in the container has introduced thereinto, via an open portion thereof referred to below as the inlet, a set amount of a first substance which has thermosetting properties and is suitably a resin, this first substance being at a temperature such that it may be caused to flow when subjected to a certain artifically applied pressure, but does not flow naturally. This process is carried out in vacuum conditions, and in normal practice a plurality of articles positioned in the same container receive set amount of the first substance in a similar manner.

Next, the article is transferred into a vat containing a second substance which is suitably a wax or substance having similar properties, which is in a liquid or near liquid state, which is unreactive with respect to the first substance and which melts at a temperature which is between the initial curing temperature and final curing temperature of the first substance. The molten substance into which the resin-coated transformer is dipped preferably has a very short softening range, i.e., the substance is preferably a substance which remains solid up to a certain temperature, and the viscosity of which falls rapidly upon heating thereof beyond this temperature. After solidification of the first substance, heat is supplied to effect curing of the first substance, the second substance still acting to prevent leakage of the first substance while the first substance passes through thermoplastic stages during curing thereof. When the temperature of final curing of the first substance is approached, the second substance melts and the article is removed from the vat, the first substance having become hard by this time and so remaining in requisite contact with the article. In other words in the method of the invention the first substance may be retained within or around an article during curing thereof by a second substance which is not required to have a definite shape and is automatically removed upon the final curing temperature of the first substance being reached. Thus there is no need for provision of individual molds of expensive material and of specific sizes, and protective or insulatory encapsulation of large numbers of articles may be effected in an easily supervised manner.

According to the invention the first substance is suitably a thermosetting resin or similar plastic substance, and the second substance may be a wax-like substance or a substance in the form of a colloidal solution which gels rapidly or rapidly becomes a sol at certain temperatures. Also, to further ensure that the first substance remains in contact with the article during transfer of the article to the vat containing the second substance in a liquid state, a fibrous material may be preliminarily wound around the article.

A better understanding of the present invention may be had from the following full description which is given in the form of several specific examples of the invention, and taken partly in reference to the attached drawings in which like numbers refer to like parts, and FIG. 1 is a perspective view of a winding of a power transformer shown as an example of an article suitable for encapsulation by the method of the invention;

FIG. 2 is a cross-sectional view of the winding of FIG. 1;

FIGS. 3(*a*) and 3(*b*) are cross-sectional views showing examples of the connection of coils of a power transformer;

EXAMPLE 1

Figure 1:
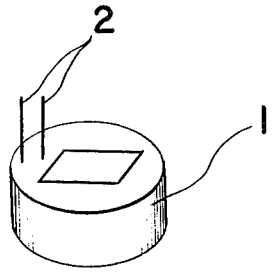

A variety of substances were employed as the second substance, these substances including wax substances which liquefy rapidly and flow upon reaching a certain melting point, for example animal or vegetable waxes in the form of esters of higher order organic acids and alcohols, mineral waxes containing saturated hydrocarbons, or synthetic waxes. Alternatively, it was found that the same results were achieved by employing thermoplastic resin as the second substance.

After preparation of a bare coil of a transformer, the bare coil was placed in a suitable container and while therein had thermosetting resin introduced thereinto under vacuum conditions, whereby the resin coated the coil and was contained in open portions thereof. The resin-coated coil was then removed from the container and introduced into a vat containing soft or liquid wax such as described above, which was non-reactive with respect to the resin and which melted at a temperature higher than the primary curing temperature of the resin but lower than the final curing temperature thereof. The wax and resin were also mutually insoluble. At this stage therefore, the coil and resin were enclosed in the wax. Next, heat was supplied to effect curing of the resin, during which process the wax prevented the resin from moving out of contact with the coil even while the resin passed through thermoplastic stages during curing thereof. When the melting point temperature of the wax was reached, at which time the resin had hardened and so was able to remain naturally in required contact with the coil, without necessity for retaining means, the coil was removed from the vat and final curing of the resin was effected, there thus being obtained a resin-encapsulated coil. Needless to say, when the coil is removed from the vat a coating of wax may remain in adherence thereto. Such a coating may be removed in a simple manner, for example by application of heat or use of a suitable solvent, However, removal is not essential since wax is a dielectric and in no way affects the characteristics of the coil.

To completely ensure prevention of leakage of resin during transfer of the coil from the abovementioned container to the vat containing wax, there may be preliminarily wound around or applied on the coil material such as a film of porous insulatory material, paper, non-woven cloth, glass cloth, or glass roving. If applied, such material further acts to improve insulatory protection of the coil, as well as acting to prevent leakage of the resin. Leakage of the resin during transfer of the coil from the container to the vat may also be prevented by addition to the resin of a filler or other suitable substance for increasing the viscosity thereof.

More specifically, the outer surfaces of the coils were enclosed in high-strength fibrous material, which was applied on or wound around the coils. High-strength fibrous materials employed include inorganic fibrous materials such as glass tape, glass roving or other forms of glass fiber, alumina fiber, or silica fiber, organic fibrous materials such as Kevlar (Trade Name used by Du Pont), or mixtures of such organic or inorganic fibrous materials with materials such as polyester fiber or polyamide fiber. Epoxy resin containing a hardening agent was introduced into interior portions and around coils thus enclosed, and the coils were then transferred into a vat which was maintained at a temperature of 90° C and contained liquid wax having a melting point of 75° C. The wax was then solidified and curing of the resin commenced at 60° C. The curing temperature was then raised to 80° C, the coils being removed from the vat when the wax melted. Final curing of the resin was effected by raising the temperature to 100° C, and there were thus obtained coils encapsulated in hard protective resin.

EXAMPLE 2

Coils were enclosed in a high-strength fibrous material such as employed in Example 1, had introduced thereinto epoxy resin, were transferred into a vat containing wax which has a melting point of 75° C and was heated to 90° C. The wax was cooled and curing of the resin commenced at 60° C, after which the curing temperature was raised first to 80° C, the coils being removed from the vat when the melting temperature of the wax was reached, and then to a final curing temperature of 100° C, whereby resin-encapsulated coils were obtained.

EXAMPLE 3

In this case the second substance employed was a substance which, when in the liquid state, is in the form of a colloidal solution and when in the solid state is in the form of a gel, and which may be reversibly transformed from gel to sol states. The substance employed was such that the sol point thereof, i.e., the temperature above which the substance loses its solid characteristics and is transformed into a liquid colloidal solution, is higher than the primary curing temperature of the resin. The gel point of such a substance, i.e., the temperature below which the substance loses its liquid characteristics and solidifies to a gel, is generally lower than the sol point thereof. According to the present invention, advantage taken of this difference between the sol point temperature and the gel point temperature in effecting encapsulation of transformer coils or other articles in resin, although it is not of course essential to the hardening of the resin that the sol point and gel point be at different temperatures.

Bare coils were positioned in a suitable container, has resin introduced thereinto, and were then transferred into a vat containing liquid resin which constituted a second substance such as described above and which had added thereto suitable addition of a gelling agent to make the sol point thereof occur at a higher temperature than the primary curing temperature of the resin.

The vat was then cooled in order to cause the second substance to gel. At this time the resin introduced into the coils did not harden since it had not had a gelling agent added thereto, but although liquid was prevented from leaking from the coils by the hardened second substance surrounding the coils. After this the temperature was steadily raised in order to effect curing of the resin encapsulating the coils. The final curing temperature of the resin being higher than the sol point of the second substance, the second substance became liquid before final curing of the resin. The coils were removed from the vat when the second substance became liquid and final curing of the resin was effected outside the vat, thereby producing resin-encapsulated coils.

In more detail, coils having been enclosed or covered by high-strength fibrous material such as employed in Example 1 had introduced thereinto epoxy resin to which 3 parts per 100 of a hardening agent had been added. The coils were then transferred into a vat containing an epoxy resin to which 0.5 parts per 100 of a hardening agent and 5 parts per 100 of a gelling agent had been added, which had a gel point of 80° C and a sol point of 110° C, and which was at 90° C, and therefore in liquid form, at the time of transfer of the coils. The vat and its contents were then cooled to below 80° C, whereby the liquid resin in which the coils were immersed was transformed into a gel surrounding the coils. Temperature was then raised to 90° C to start curing of the encapsulating resin, and subsequently further raised to 130° C. During this process the sol point of the resin initially contained in the vat was reached, whereby this resin again became liquid, and was drained away from the coils, this being effected for example by placing the gelled resin containing the coils on a metal mesh or similar means. Final curing of the encapsulating resin was effected by further raising the temperature to 150° C, during which stage any resin which was initially provided in the vat and which remained in adherence, in gel form, to the outer surfaces of the coils was cured together with the encapsulating resin.

EXAMPLE 4

Figure 2:
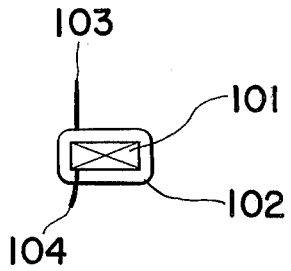

Referring to FIG. 1, there is shown an external view of a high voltage coil 1 which is to be encapsulated by the method of the invention, and having external leads 2. As shown in the cross-sectional view of FIG. 2, the coil 1 comprises a plurality of layers constituted by separate windings 101. Since the windings are separated, interlayer voltage is lowered whereby normally employed interlayer insulation material may be omitted and the external diameter of the coil may be reduced. Around the coil windings there is formed an insulatory layer 102, which is produced by application into and around the windings of a resin material, this application being effected after formation of the coil windings and after a high-strength fibrous material such as employed in Example 1 has been wound around or applied on the windings. This fibrous material serves to absorb any stress to which the coil may be subjected due to thermal shock during cooling or heating, etc., and, due to capillary action, also serves to retain resin in requisite contact with the coil prior to curing of the resin, and so renders the use of metal molds unnecessary. The coil is provided with leads 103 and 104 for external electrical connection.

Figure 3:
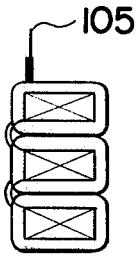
Figure 3:
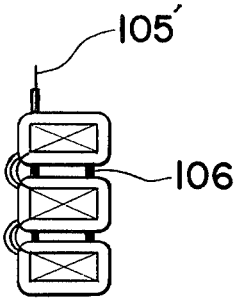

FIG. 3 shows examples of assembly of three connected coils 1 which have common external leads 105 and 105' respectively, FIG. 3 (*a*) showing an assembly wherein there is no spacing between the component coils, and FIG. 3(*b*) an assembly wherein spacers 106 are provided between component coils, in order to facilitate cooling of the assembly. Assemblies such as shown in FIG. 3 where encapsulated in resin by the method described in Example 1, and were then mounted together with iron cores, thereby to form transformers protected by resin insulation.

EXAMPLE 5

Figure 4:
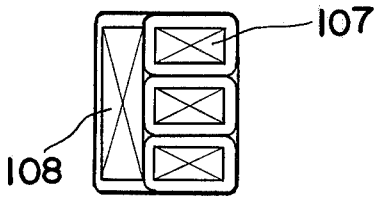
FIG. 4 is a cross-sectional view showing the relative disposition of low voltage coils and high voltage coils in a power transformer.

As illustrated in FIG. 4 required high voltage bare coils 107 and low voltage bare coils 108, formed in the manner employed in Example 4, are provided independently and connected mechanically, and then after encapsulation thereof in resin by the method of Example 1, are assembled with an iron core to provide a resin-protected dry-type transformer. In this example, since resin encapsulation is effected after assembly of the high voltage coil, mechanical bonding between high voltage coil portions is strengthened, and there is much improved resistance to externally applied stress due to vibration or momentary short circuits, for example.

EXAMPLE 6

Figure 5:
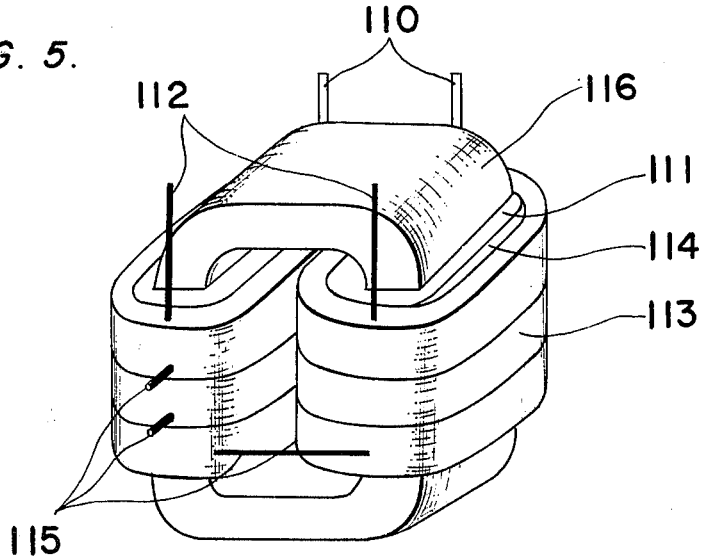
FIG. 5 is a perspective view of a power transformer assembly including a high voltage coil, an iron core and a low voltage coil.

In this example there was first assembled a transformer such as shown in FIG. 5, which includes a low voltage coil 111 connected to external leads 110, a high voltage coil 113 connected to external leads 112 and an iron core 116 encricled by the coils 111 and 113, gaps 114 being defined as necessary between the core 116 and coils 111 and 113. This entire assembly received an application of resin by the method of Example 1, thus providing a resin-encapsulated transformer. Electrical connection between the various component parts of the high voltage coil was provided by a wire or wires 115. In this example, since resin was applied after mechanical connection of the high voltage coil, low voltage coil and iron core, the mechanical bond between these elements was further strengthened upon hardening of the cured resin, whereby there was obtained a transformer having a resistance to external stress which was much improved compared with a transformer wherein each component element was fixed individually.

Figure 6:
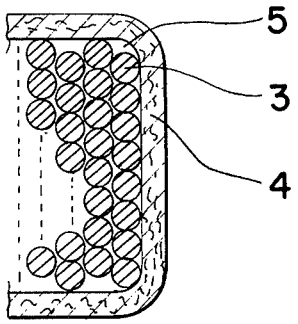
FIGS. 6 through 8 are enlarged cross-sectional views showing portions of a transformer coil prepared for encapsulation according to the method of the invention.

Encapsulated coils having excellent electrical and mechanical characteristics were produced by the methods of the abovedescribed Examples 1 through 6 and when assembled with iron cores provided well insulated transformer assemblies. However, a point to be noted when high-strength fibrous material such as described above is preliminarily wound around or applied on coils to be encapsulated is that there may be gaps formed between the fibrous material and conductors, there being a particular tendency for such gaps to be formed in coils employing round wires as conductors. For example, as shown in the cross-section of FIG. 6, gaps 5 are formed between a coiled conductor 3 and an insulatory layer 4 constituted by high-strength fibrous material wound around the coiled conductor 3. When the first substance is subsequently introduced into and around the coiled conductor 3, the gaps 4 become filled with the first substance, i.e., the first substance is in direct contact with the conductor 3, A problem in this case is that generally, the coefficient of expansion of an epoxy resin or other material having optimum properties for encapsulation and insulatory protection of the conductor 3 is considerably different from that of the conductor 3, the portion of the encapsulating resin which fills any particular gap 3 between two turns of wire is very thin, and heat generated in the coiled conductor 3 may result in stress, which, since the encapsulating resin is also subject to external stress applied by the fibrous material forming the layer 4, causes cracking in the encapsulating resin. Thus it is preferably to provide in immediate contact with the conductor 3 a layer of material having a coefficient of expansion close to that of the conductor 3.

Figure 7:
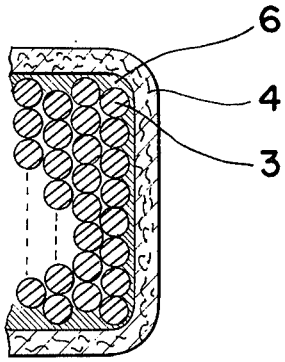

In more detail, and referring to FIG. 7, after production of the bare coil a buffer layer 6 is provided around the outer surface thereof. The buffer layer 6 suitably constitutes an insulation layer, is composed of a powder material in a resin, and may be applied by a fluidized bed technique, an electrostatic fluidized bed technique, or other suitable techniques, whereby the layer 6 covers the coiled conductor 3 and provides a rough outer surface onto which the high-strength fibrous material may be applied. After this an encapsulated coil or transformer may be produced by the methods of the abovedescribed examples, in which case, encapsulating resin fills gaps between the buffer layer 6 and the fibrous material layer 4, and the buffer layer 6 absorbs any stress which may occur due to thermal expansion of the conductor 3. In production of the buffer of the buffer layer 6 it is convenient to provide powder material in resin which is semi-cured, or at the so-called B stage, rather than in resin which has had filler added thereto and has been fully reacted. The buffer layer 6 may of course be constituted by other material, for example, by a flexible resin material, or an elastic material such as rubber, or the layer 6 may be a resin layer containing a large amount of inorganic material.

The wire of bare coils prepared in the abovedescribed manner may be conventional enamel-coated wire, in which case it is convenient to employ so-called fuse-bonded wire, i.e., wire having provided above the enamel coating thereof a thermoplastic or thermosetting bonding layer which upon application of heat melts and bonds the turns of wire to form an integral whole. In this case therefore there are present between conductor turns no gaps into which small portions of subsequently applied resin which are particularly sensitive to stress may enter, and there is thus obtained a coil or transformer assembly which imposes less restrictions during handling thereof.

Figure 8:
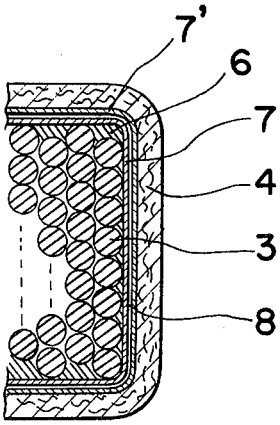

An assembly with further improved mechanical characteristics and resistance to stress due to thermal shock or other causes may be obtained by provision of a spacing layer between a bare coil and the fibrous material applied thereon. In more detail, referring to FIG. 8, on the outer side of the buffer layer 6 there is provided a spacing layer 8 which is formed between semiconductor layers 7 and 7', and insulation layer 4 constituted by high-strength fibrous material being provided on the outer side of this assembly. Since the semiconductor layers 7 and 7' are brought to the same electrical potential, deterioration of insulation of the coil due to application of voltage and partial discharge in the spacing layer 8 is prevented, in addition to which the layers 7, 7' and 8 also serve as an electric field buffer layer. The resistance of the semiconductor layers 7 and 7' is most suitably in the range $10^2 - 10^8$ Ω/cm, although values outside this range may be employed. In this case, if the layers 7, 7' and 8 are sufficient to ensure insulation of the coiled conductor 3, the buffer layer 6 may be omitted. The layers 7 and 7' may be constituted by a conductor, instead of a semiconductor, material, but in this case care must be taken to ensure that the layers do not form an electrically closed circuit. After preparation of coils in this manner, encapsulated coils may be produced by the methods of Example 1 through 3, or encapsulated transformer may be produced by the methods of Examples 4 through 6.

As described above, the advantages of the method of the invention include the following advantages.

1. Since metal molds are unnecessary, the problems of expense and work set-ups associated with method employing metal molds are avoided.

2. Further economy is provided since only a necessary thickness of insulation material is provided, and there is no insulation material over portions of a part not requiring insulation, as in methods using metal molds.

3. The method of the invention permits employment of a batch system for simultaneous production of large numbers of encapsulated parts.

4. Since leakage of encapsulating resin during curing thereof is prevented, layers free of voids and providing excellent insulatory protection may be obtained.

5. Since coils or other parts may be enclosed in high-strength fibrous material and metal molds are unnecessary, adhesion of unnecessary resin is avoided and excellent resistance to mechanical or thermal stress is provided.

Needless to say, although the invention has been described above principally in reference to encapsulation of a coiled conductor or transformer, it will be apparent that the method of the invention is equally applicable to encapsulation or provision of protective covering to many other kinds of articles.

What is claimed is:

1. An article encapsulation method comprising the steps of applying a first substance having thermosetting characteristics and able to provide requisite protection to an article when hardened around and into interior portions of the article to be encapsulated, said first substance being in a precured state during said application, whereby said first substance adheres to and covers surface portions of said article, immersing said article having said first substance adhering to said surface portions thereof in a second substance which is reversibly transformable from a solid to a liquid state, melts at a temperature which is between the primary curing temperature and final curing temperature of said first substance, is non-reactive with respect to said first substance and is in a liquid state upon immersion of said article thereinto, said first and second substances being mutually insoluble, cooling said second substance to below the solidification point thereof immediately subsequent to said immersion of said article thereinto, supplying heat to effect curing of said first substance, and moving said article out of contact with said second substance subsequent to hardening of said first substance during the curing thereof and after melting of said second substance.

2. An article encapsulation method as claimed in claim 1, which further includes the step of applying a high-strength fibrous material around an article to be encapsulated prior to said application of said first substance.

3. An article encapsulation method as claimed in claim 2, which further includes the step of providing a buffer layer around the article to be encapsulated prior to application of said high-strength fibrous material.

4. An article encapsulation method as claimed in claim 2, which further includes the step of providing spacer and absorption means around an article to be encapsulated prior to said application of said high-strength fibrous material.

5. An article encapsulation means as claimed in claim 1, wherein said first substance is an epoxy resin.

6. An article encapsulation method as claimed in claim 1, wherein said epoxy resin contains a filler.

7. An article encapsulation method as claimed in claim 1, wherein said second substance is a wax.

8. An article encapsulation method as claimed in claim 1, wherein said second substance is a substance which is reversibly transformable from a colloidal solution to a gel state.

9. An article encapsulation method as claimed in claim 8, wherein said reversibly transformable substance is an epoxy resin having of 0.5 parts per 100 of a hardening agent and 5 parts per 100 of a gelling agent added thereto.

* * * * *